US007056105B2

(12) United States Patent
Liu et al.

(10) Patent No.: US 7,056,105 B2
(45) Date of Patent: Jun. 6, 2006

(54) UNIT UTILIZING CURRENT TO CONTROL RECIPROCATION FOR PUSHING FLUIDS

(76) Inventors: Ming-Hwa Liu, No. 117, Chung Chun Rd., Pei Tou Chen, Chang Hua Hsien (TW); Brian D. F. Chen, No. 205, Lider Street, East District, Taichung (TW); Cheng-Pang Chang, No. 36-2, Ting Yuan Lin, Ta Lin Chen, Chia Yih Hsien (TW)

( * ) Notice: Subject to any disclaimer, the term of this patent is extended or adjusted under 35 U.S.C. 154(b) by 362 days.

(21) Appl. No.: 10/722,537

(22) Filed: Nov. 28, 2003

(65) Prior Publication Data

US 2005/0118043 A1 Jun. 2, 2005

(51) Int. Cl.
*F04B 39/10* (2006.01)

(52) U.S. Cl. ..... 417/534; 417/418; 417/560; 417/417; 417/415; 137/533.19

(58) Field of Classification Search ..... 417/534, 417/418, 560, 410.1, 415, 417; 137/533.19
See application file for complete search history.

(56) References Cited

U.S. PATENT DOCUMENTS 461,295 A * 10/1891 Van Depoele ..... 417/418
2,283,886 A * 5/1942 Henkell ..... 310/34
3,134,938 A * 5/1964 Morgan ..... 318/130
3,162,134 A * 12/1964 Lovell ..... 417/326
3,664,774 A * 5/1972 Tupper et al. ..... 417/560
3,754,154 A * 8/1973 Massie ..... 310/30
4,272,226 A * 6/1981 Osborne ..... 417/418
4,375,941 A * 3/1983 Child ..... 417/53

* cited by examiner

*Primary Examiner*—Charles G. Freay
*Assistant Examiner*—Emmanuel Sayoc
(74) *Attorney, Agent, or Firm*—Troxell Law Office, PLLC

(57) ABSTRACT

A unit utilizing current to control reciprocation for pushing fluids, including a chamber, a magnet, a coil connected with a circuit, a first inlet, a first outlet, a second inlet, a second outlet, a first valve and a second valve. The magnet is slidably disposed in the chamber. The coil is disposed around the chamber for driving the magnet to reciprocally move. The first inlet and first outlet are disposed at one end of the chamber. The second inlet and second outlet are disposed at the other end of the chamber. The first valve is disposed between the first inlet, the first outlet and the chamber. The second valve is disposed between the second inlet, the second outlet and the chamber. The magnet can drive the first and second valves to suck a fluid into the first and second inlets and push a fluid out of the first and second outlets.

22 Claims, 7 Drawing Sheets

UNIT UTILIZING CURRENT TO CONTROL RECIPROCATION FOR PUSHING FLUIDS

BACKGROUND OF THE INVENTION

The present invention is related to a device for pushing a fluid, and more particularly to a unit utilizing current to control reciprocation for pushing fluids.

The conventional pumping device is used to push a fluid to flow in a pipeline. The pumping device generally includes a water wheel apparatus or a pump unit communicating with a pipeline and externally connected with a motor. The motor operates to drive the water wheel to rotate or drive the pump unit to reciprocally move for pushing the fluid. Therefore, the fluid can be circulated in the pipeline or transferred from one place to another place.

The conventional pumping device is equipped with the motor so that the much room is occupied and the cost is relatively high. Also, one single pipeline system is often equipped with one single pump. Alternatively, one single pumping device can be used in cooperation with two pipeline systems. In this case, many switch valves or check valves must be mounted on the two pipeline systems. This leads to high cost and inconvenience in use.

U.S. Pat. No. 6,364,003 of this applicant discloses a device in which five magnets are disposed in a chamber. The chamber is formed with several openings. A coil provided with variable current direction serves to drive one of the magnets to reciprocally move so as to alternately push two fluids. Such measure is applicable to liquid-cooled or phase-change cooling system. Especially, this measure can suck in the cold air in the environment to serve as a heat-absorbing coolant. When assembled, it should be noted that the same poles of the five magnets are directed to each other.

SUMMARY OF THE INVENTION

It is therefore a primary object of the present invention to provide a unit utilizing current to control reciprocation for pushing fluids. By means of one single coil and one single magnet, the fluid can be pushed.

It is a further object of the present invention to provide the above unit utilizing current to control reciprocation for pushing fluids, which can drive the fluid of one pipeline system or fluids of two independent pipeline systems.

It is still a further object of the present invention to provide the above unit utilizing current to control reciprocation for pushing fluids, by which it is no more necessary to dispose multiple switch valves or check valves on the pipeline systems connected with the unit.

According to the above objects, the unit utilizing current to control reciprocation for pushing fluids of the present invention includes a chamber, a magnet, a coil connected with a circuit, a first inlet, a first outlet, a second inlet, a second outlet, a first valve and a second valve.

The present invention can be best understood through the following description and accompanying drawings wherein:

DETAILED DESCRIPTION OF THE PREFERRED EMBODIMENTS

Figure 1:
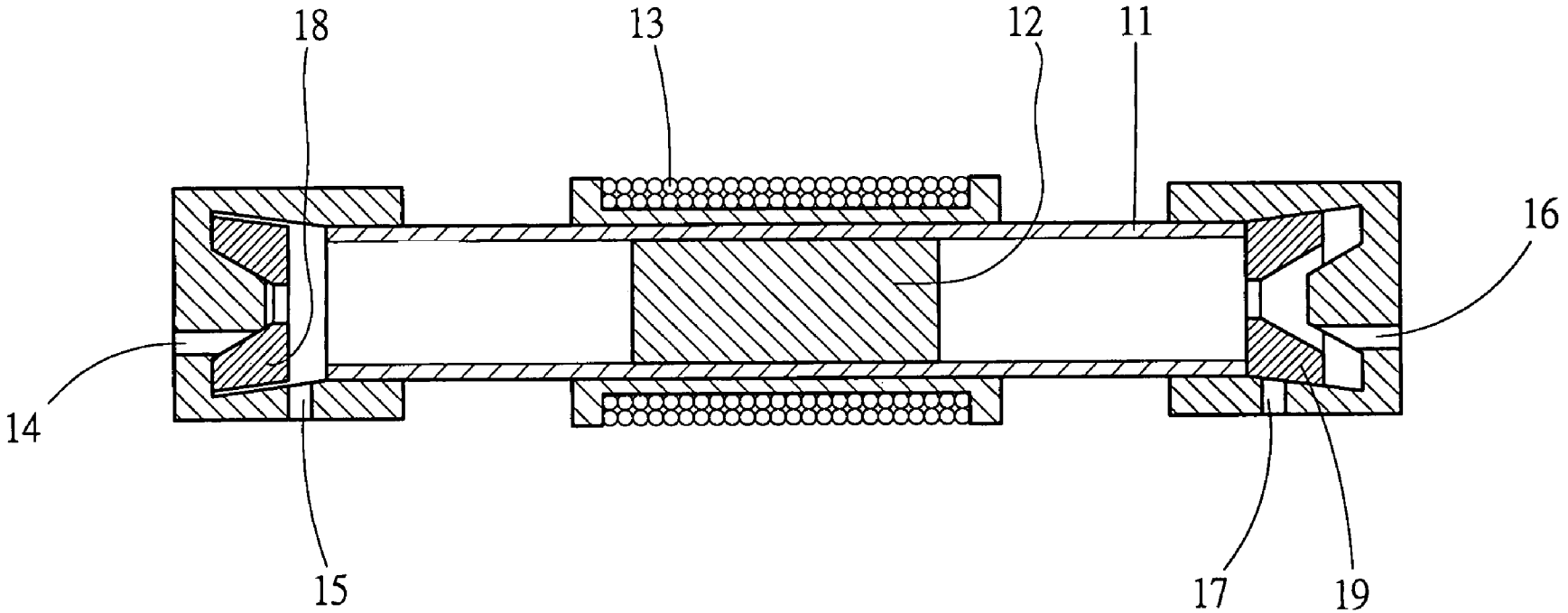
FIG. 1 is a sectional view of a first embodiment of the present invention.
Figure 2:
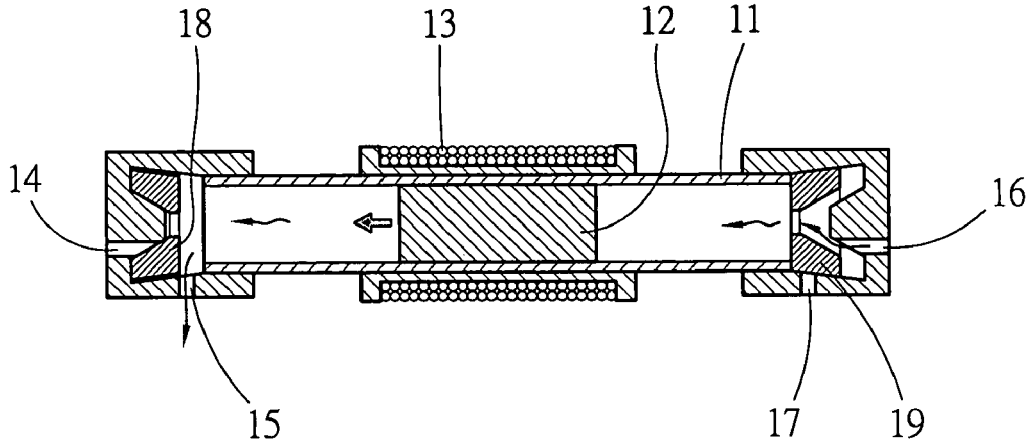
FIGS. 2 to 7 show the operation of the first embodiment of the present invention and the flowing of the fluid.
Figure 3:
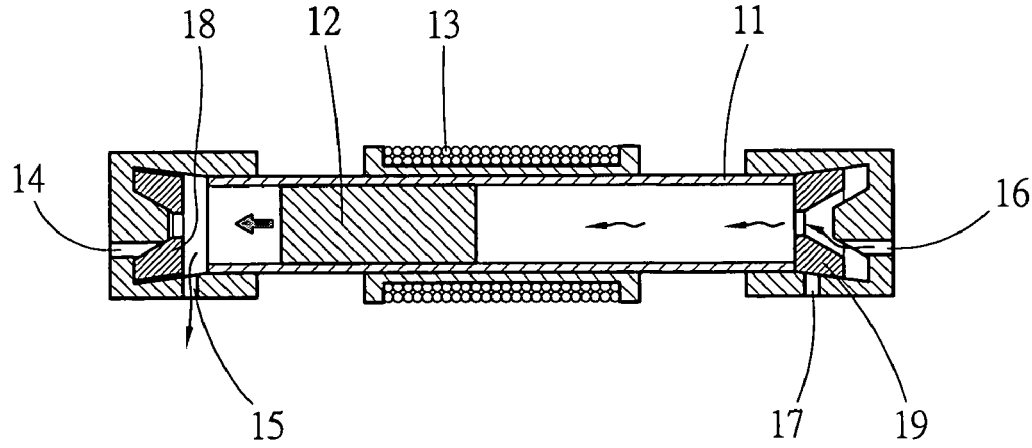
Figure 4:
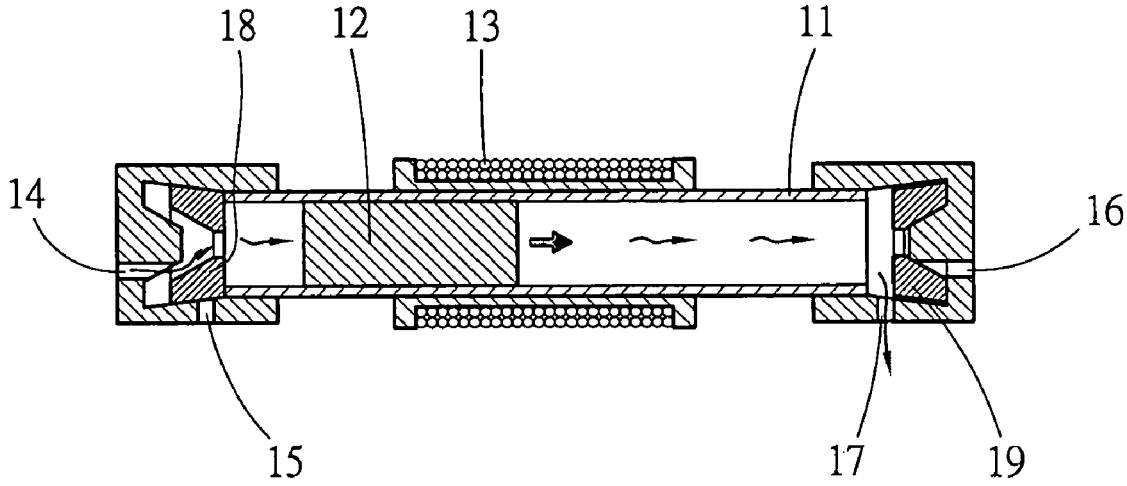
Figure 5:
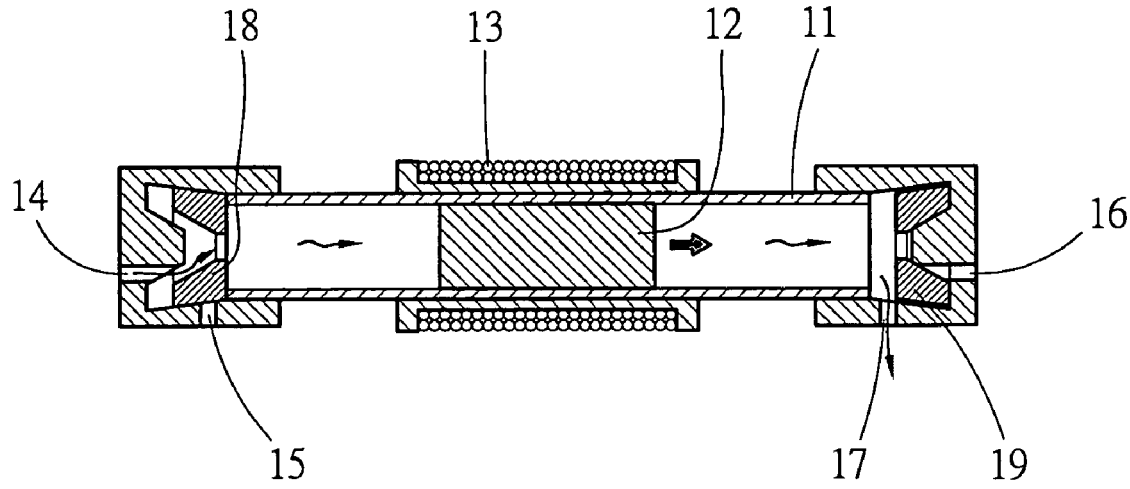
Figure 6:
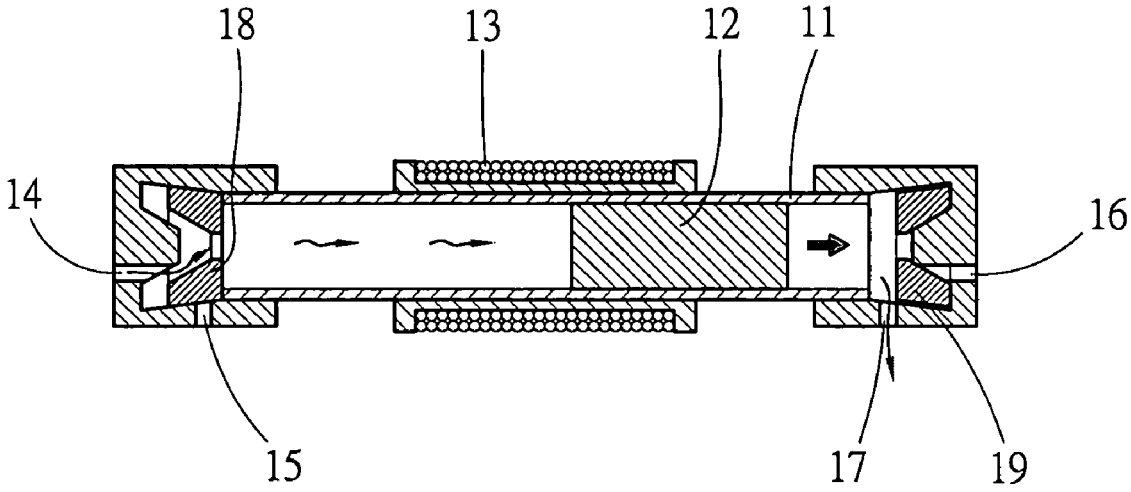
Figure 7:
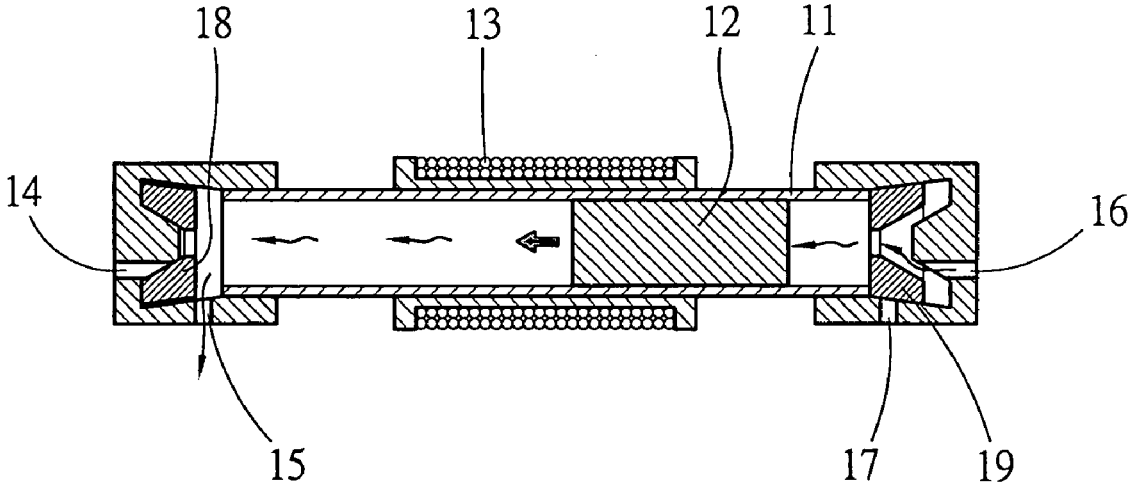
Figure 8:
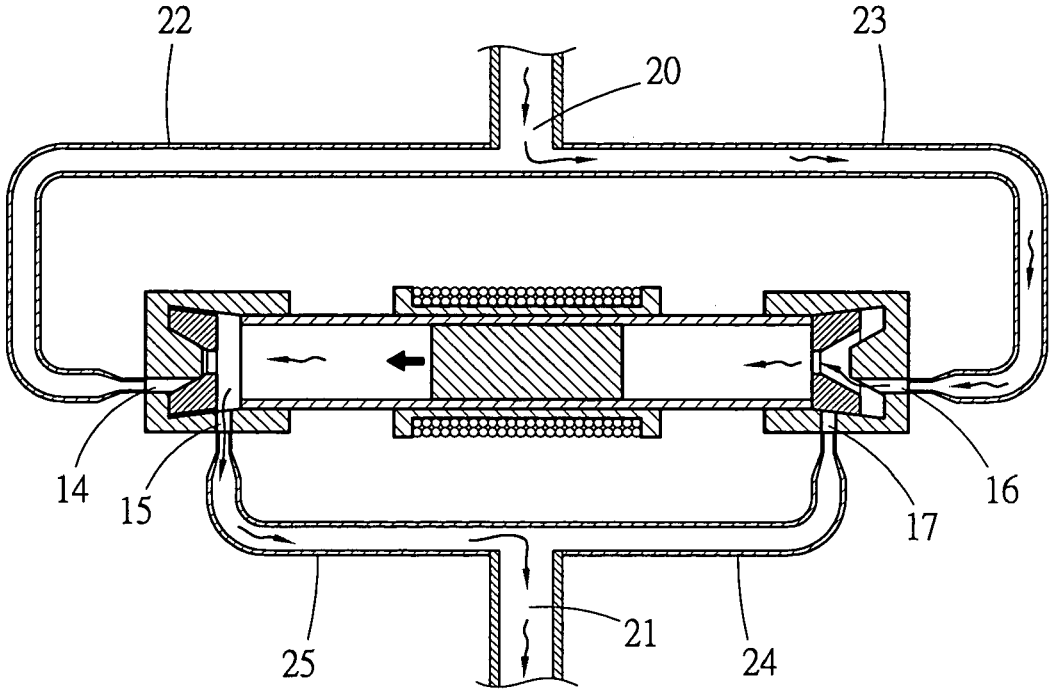
FIGS. 8 to 13 show the operation of a second embodiment of the present invention and the flowing of the fluid.
Figure 9:
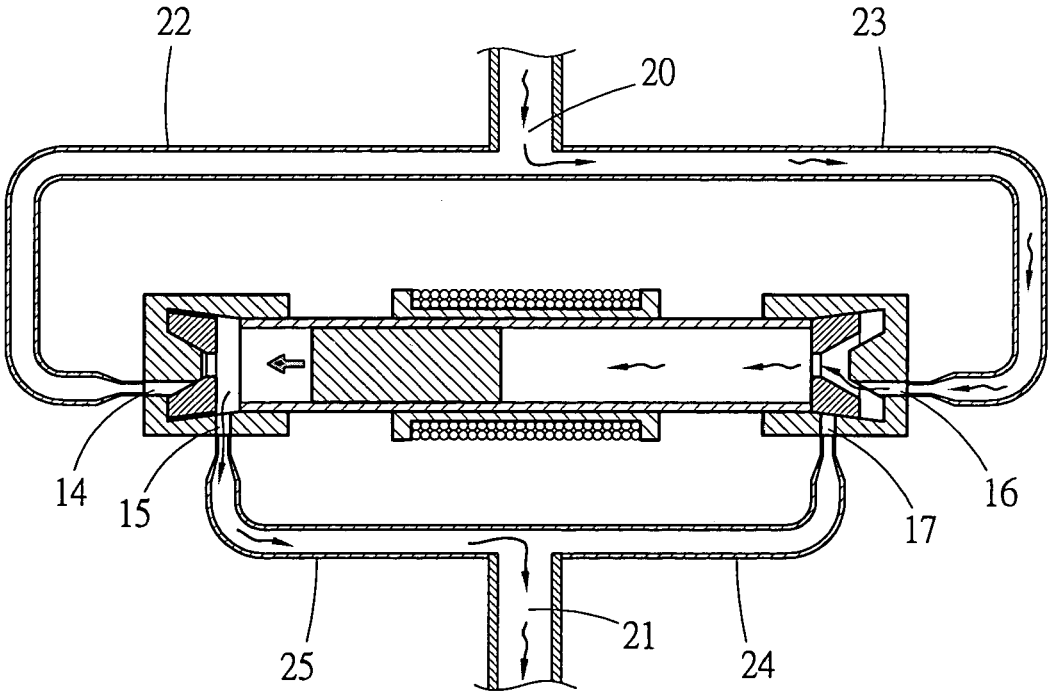
Figure 10:
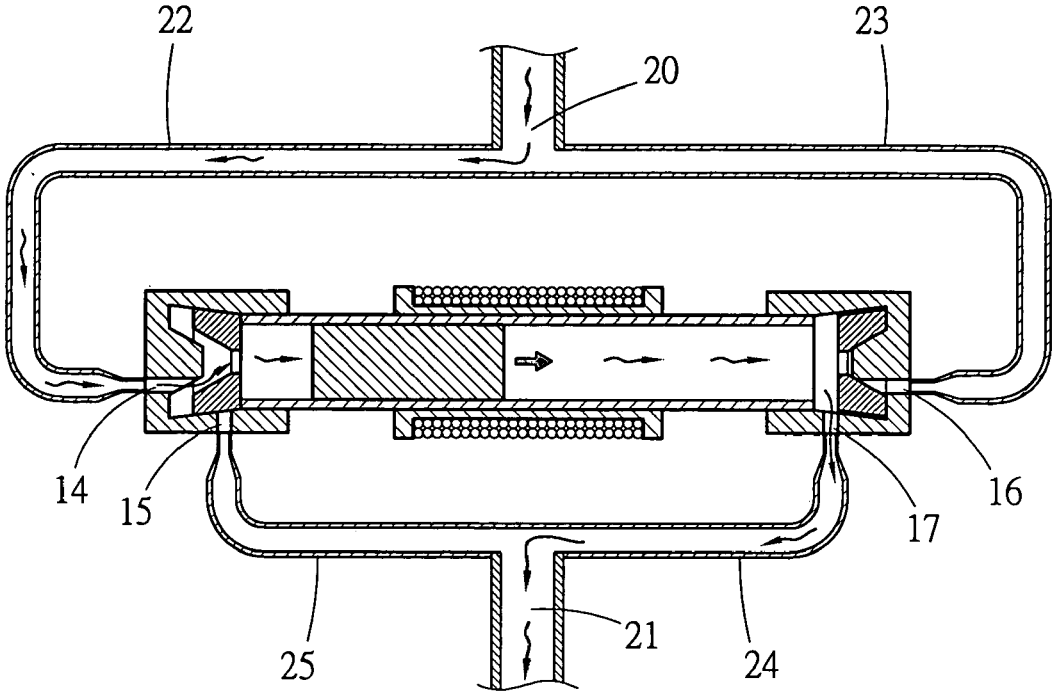
Figure 11:
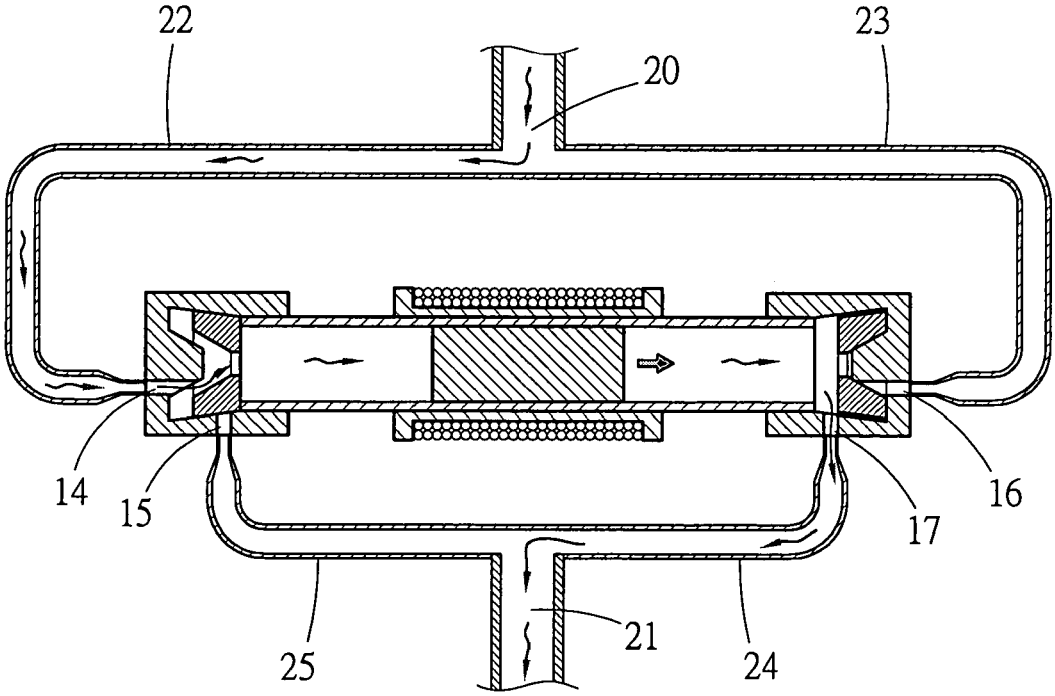
Figure 12:
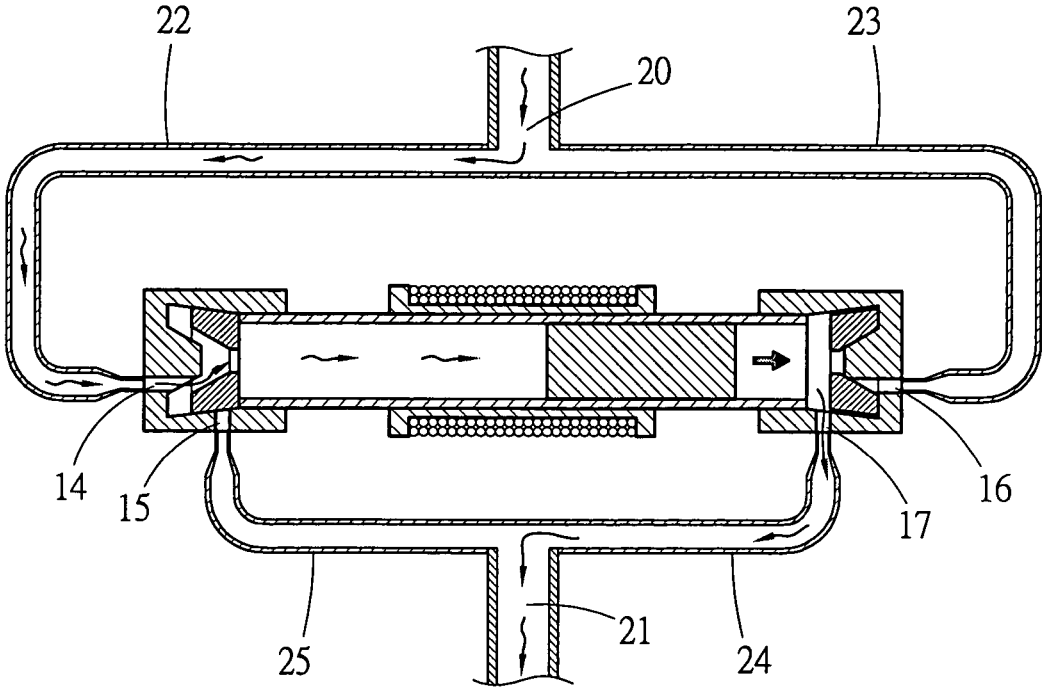
Figure 13:
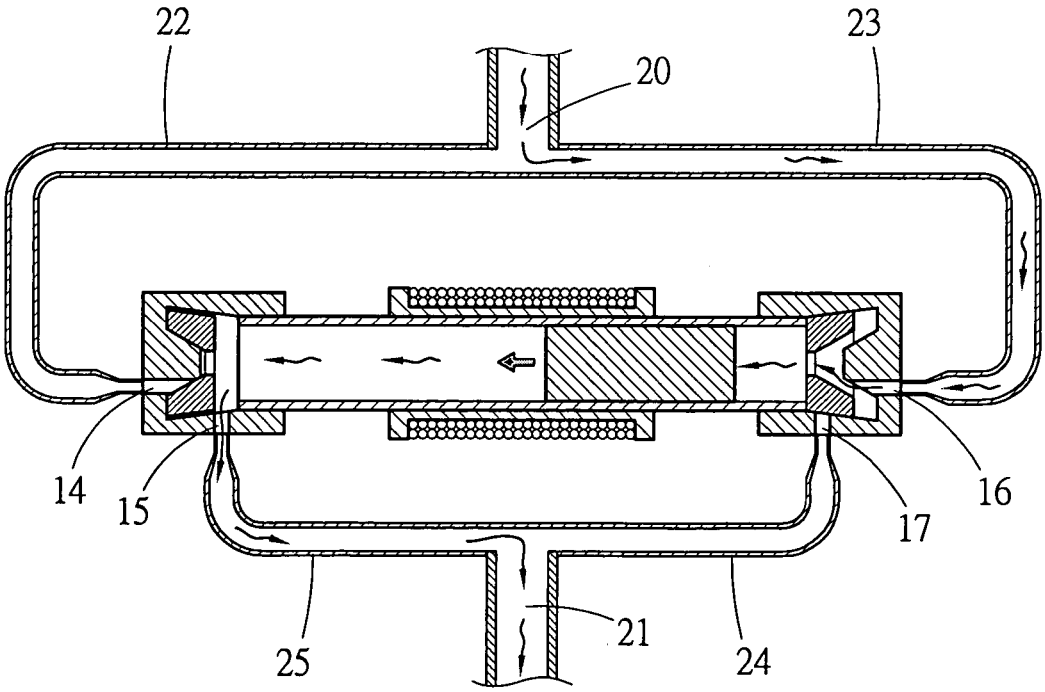

Please refer to FIG. 1. The unit utilizing current to control reciprocation for pushing fluids of the present invention includes a chamber 11, a magnet 12, a coil 13, a first inlet 14, a first outlet 15, a second inlet 16, a second outlet 17, a first valve 18 and a second valve 19.

The chamber 11 has a certain length and two openings at two ends. The chamber 11 can be a tubular body.

The magnet 12 has a certain length. The shape of the outer circumference of the magnet 12 corresponds to the shape of the inner circumference of the chamber 11, whereby the magnet 12 is slidably disposed in the chamber 11.

The coil 13 is disposed on outer side of the chamber 11 and connected with a circuit. The circuit provides a cyclically variable or a variable current direction for the coil 13 for driving the magnet 12 to reciprocally move.

The first inlet 14 and first outlet 15 are disposed at one end of the chamber 11.

The second inlet 16 and second outlet 17 are disposed at the other end of the chamber 11.

The first valve 18 is disposed between the first inlet 14, the first outlet 15 and the chamber 11. The first valve 18 is movable between a first position and a second position. In the first position, the first valve 18 blocks the first inlet 14 without blocking the first outlet 15. In the second position, the first valve 18 blocks the first outlet 15 without blocking the first inlet 14.

The second valve 19 is disposed between the second inlet 16, the second outlet 17 and the chamber 11. The second valve 19 is movable between a third position and a fourth position. In the third position, the second valve 19 blocks the second inlet 16 without blocking the second outlet 17. In the fourth position, the second valve 19 blocks the second outlet 17 without blocking the second inlet 16.

Referring to FIGS. 2 to 7, when the magnet 12 gets close to the first valve 18, the first valve 18 is positioned in the first position, while the second valve 19 is positioned in the fourth position. A fluid is pushed out of the first outlet 15, while a fluid is sucked into the second inlet 16. When the magnet 12 gets close to the second valve 19, the first valve 18 is positioned in the second position, while the second valve 19 is positioned in the third position. A fluid is pushed out of the second outlet 17, while a fluid is sucked into the first inlet 14.

According to the above arrangement, the unit utilizing current to control reciprocation for pushing fluids of the present invention has the following advantages:

1. By means of one single magnet, two inlets, two outlets and two valves, a fluid can be transferred.
2. The present invention can drive the fluid of one pipeline system or fluids of two independent pipeline systems.
3. It is unnecessary to dispose multiple switch valves or chick valves on the pipeline systems connected with the present invention.

Referring to FIGS. 8 to 13, the present invention further includes an outgoing connecting section 20 of a pipeline, an incoming connecting section 21 of a pipeline 21, a first communicating section 22, a second communicating section 23, a third communicating section 24 and a fourth communicating section 25.

The first communicating section 22 serves to communicate the first inlet 14 and the outgoing connecting section 20 of the pipeline.

The second communicating section 23 serves to communicate the second inlet 16 and the outgoing connecting section 20 of the pipeline.

The third communicating section 24 serves to communicate the second outlet 17 and the incoming connecting section 21 of the pipeline.

The fourth communicating section 25 serves to communicate the first outlet 15 and the incoming connecting section 21 of the pipeline.

By means of the first, second, third and fourth communicating section, the outgoing connecting section and the incoming connecting section, the present invention can more easily connect the pipeline and achieve the transferring function.

The present invention further includes a first enclosing member and a second enclosing member. The first enclosing member encloses the coil 13 and can be made of material for forming more effective magnetic path and more effectively guiding a magnetic field of the coil 13 to drive the magnet 12. The second enclosing member encloses the first enclosing member and the chamber 11. The second enclosing member can be a sleeve made of nonmetallic material or metal material such as copper for achieving protective effect.

The present invention further includes a coating coated on inner or outer face of the second enclosing member. In the case that the second enclosing member is made of nonmetallic material such as plastic, the coating can be a metal coating such as nickel. In the case that the second enclosing member is made of metallic material, the coating can be a nonmetallic coating such as resin. The coating serves to enhance the protection effect or achieve a beautifying effect.

The present invention further includes a surrounding section fitted around the magnet 12 between the inner face of the chamber 11 and the magnet 12. The surrounding section serves to contact with the inner face of the chamber 11 to achieve a true watertight or airtight effect. The surrounding section can include two piston rings respectively disposed at two ends of the magnet 12.

The above embodiments are only used to illustrate the present invention, not intended to limit the scope thereof. Many modifications of the above embodiments can be made without departing from the spirit of the present invention.

What is claimed is:

1. A unit utilizing current to control reciprocation for pushing fluids, comprising:

a chamber having a certain length and two openings at two ends;

a magnet having a certain length, a shape of outer circumference of the magnet corresponding to a shape of inner circumference of the chamber, whereby the magnet is slidably disposed in the chamber;

a coil disposed on outer side of the chamber and connected with a circuit, the circuit providing a variable current direction for the coil for driving the magnet to reciprocally move;

a first inlet and a first outlet disposed at one end of the chamber;

a second inlet and a second outlet disposed at the other end of the chamber;

a first valve disposed between the first inlet, the first outlet and the chamber, the first valve being translationally movable along the axis of the chamber between a first position and a second position, whereby in the first position, the first valve blocks the first inlet without blocking the first outlet, while in the second position, the first valve blocks the first outlet without blocking the first inlet; and a second valve disposed between the second inlet, the second outlet and the chamber, the first valve being translationally movable along the axis of the chamber between a third position and a fourth position, whereby in the third position, the second valve blocks the second inlet without blocking the second outlet, while in the fourth position, the second valve blocks the second outlet without blocking the second inlet, when the magnet gets close to the first valve, the first valve being positioned in the first position, while the second valve being positioned in the fourth position, when the magnet gets close to the second valve, the first valve being positioned in the second position, while the second valve being positioned in the third position.

2. The unit utilizing current to control reciprocation for pushing fluids as claimed in claim 1, further comprising a surrounding section fitted around the magnet between the inner face of the chamber and the magnet for contacting with the inner face of the chamber.

3. The unit utilizing current to control reciprocation for pushing fluids as claimed in claim 2, wherein the surrounding section includes two piston rings respectively disposed at two ends of the magnet.

4. The unit utilizing current to control reciprocation for pushing fluids as claimed in claim 1, further comprising a first enclosing member and a second enclosing member, the first enclosing member enclosing the coil, the second enclosing member enclosing the first enclosing member and the chamber.

5. The unit utilizing current to control reciprocation for pushing fluids as claimed in claim 4, wherein the first enclosing member is made of metallic material.

6. The unit utilizing current to control reciprocation for pushing fluids as claimed in claim 4, wherein the second enclosing member is made of nonmetallic material.

7. The unit utilizing current to control reciprocation for pushing fluids as claimed in claim 4, wherein the second enclosing member is made of metallic material.

8. The unit utilizing current to control reciprocation for pushing fluids as claimed in claim 4, wherein the second enclosing member is a sleeve made of copper material.

9. The unit utilizing current to control reciprocation for pushing fluids as claimed in claim 6, further comprising a coating coated on the second enclosing member, the coating being a metal coating.

10. The unit utilizing current to control reciprocation for pushing fluids as claimed in claim 7, further comprising a coating coated on the second enclosing member, the coating being a nonmetallic coating.

11. The unit utilizing current to control reciprocation for pushing fluids as claimed in claim 9, wherein the coating is a nickel coating.

12. The unit utilizing current to control reciprocation for pushing fluids as claimed in claim 1, further comprising:

an outgoing connecting section of a pipeline and an incoming connecting section of a pipeline;

a first communicating section for communicating the first inlet and the outgoing connecting section of the pipeline;

a second communicating section for communicating the second inlet and the outgoing connecting section of the pipeline;

a third communicating section for communicating the second outlet and the incoming connecting section of the pipeline; and a fourth communicating section for communicating the first outlet and the incoming connecting section of the pipeline.

13. The unit utilizing current to control reciprocation for pushing fluids as claimed in claim 12, further comprising a surrounding section fitted around the magnet between the inner face of the chamber and the magnet for contacting with the inner face of the chamber.

14. The unit utilizing current to control reciprocation for pushing fluids as claimed in claim 13, wherein the surrounding section includes two piston rings respectively disposed at two ends of the magnet.

15. The unit utilizing current to control reciprocation for pushing fluids as claimed in claim 12, further comprising a first enclosing member and a second enclosing member, the first enclosing member enclosing the coil, the second enclosing member enclosing the first enclosing member and the chamber.

16. The unit utilizing current to control reciprocation for pushing fluids as claimed in claim 15, wherein the first enclosing member is made of metallic material.

17. The unit utilizing current to control reciprocation for pushing fluids as claimed in claim 15, wherein the second enclosing member is made of nonmetallic material.

18. The unit utilizing current to control reciprocation for pushing fluids as claimed in claim 15, wherein the second enclosing member is made of metallic material.

19. The unit utilizing current to control reciprocation for pushing fluids as claimed in claim 15, wherein the second enclosing member is a sleeve made of copper material.

20. The unit utilizing current to control reciprocation for pushing fluids as claimed in claim 17, further comprising a coating coated on the second enclosing member, the coating being a metal coating.

21. The unit utilizing current to control reciprocation for pushing fluids as claimed in claim 18, further comprising a coating coated on the second enclosing member, the coating being a nonmetallic coating.

22. The unit utilizing current to control reciprocation for pushing fluids as claimed in claim 20, wherein the coating is a nickel coating.

* * * * *